US005755346A

United States Patent [19]

Ekkert

[11] Patent Number: 5,755,346

[45] Date of Patent: May 26, 1998

[54] TAMPER INDICATING CLOSURE WITH DUAL-CAMMING PROJECTION BAND

[75] Inventor: Len Ekkert, Lemont, Ill.

[73] Assignee: Phoenix Closures, Inc., Naperville, Ill.

[21] Appl. No.: 744,003

[22] Filed: Nov. 4, 1996

[51] Int. Cl.[6] ..... B65D 49/12

[52] U.S. Cl. ..... 215/252; 215/901

[58] Field of Search ..... 215/252, 256, 215/901, 44, 45

[56] References Cited

U.S. PATENT DOCUMENTS

| | | | |
|---|---|---|---|
| 3,455,478 | 7/1969 | Fields et al. . | |
| 4,156,490 | 5/1979 | Peraboni . | |
| 4,343,408 | 8/1982 | Csaszar . | |
| 4,352,436 | 10/1982 | Chartier et al. . | |
| 4,432,461 | 2/1984 | Mumford et al. . | |
| 4,436,212 | 3/1984 | Alejandro Llera . | |
| 4,461,390 | 7/1984 | Csaszar . | |
| 4,479,586 | 10/1984 | Csaszar . | |
| 4,549,667 | 10/1985 | Dullabaun . | |
| 4,567,993 | 2/1986 | Albrecht et al. . | |
| 4,613,052 | 9/1986 | Gregory et al. . | |
| 4,669,623 | 6/1987 | Csaszar . | |
| 4,744,480 | 5/1988 | Luch et al. | 215/252 |
| 4,756,438 | 7/1988 | Ryder . | |
| 4,807,771 | 2/1989 | Roy et al. . | |
| 4,848,614 | 7/1989 | Csaszar | 215/252 |
| 4,903,849 | 2/1990 | Wallman | 215/256 |
| 4,919,285 | 4/1990 | Roof et al. . | |
| 4,978,016 | 12/1990 | Hayes . | |
| 5,092,478 | 3/1992 | La Pierre . | |
| 5,097,974 | 3/1992 | Rozenberg | 215/252 X |
| 5,135,123 | 8/1992 | Nairn et al. . | |
| 5,137,163 | 8/1992 | Moore . | |

FOREIGN PATENT DOCUMENTS

| | | | |
|---|---|---|---|
| 589254 | 3/1994 | European Pat. Off. | 215/252 |
| 85/03492 | 8/1985 | WIPO | 215/252 |
| 94/02371 | 2/1994 | WIPO | 215/252 |

*Primary Examiner*—Stephen Cronin
*Assistant Examiner*—Nathan Newhouse
*Attorney, Agent, or Firm*—Welsh & Katz, Ltd.

[57] ABSTRACT

A tamper indicating closure for use with an associated container includes a closure cap having a circular top wall portion, and a depending annular skirt portion depending from the top wall portion. The skirt portion has an internal thread formed therein adapted to threadedly engage a thread formed on an outer surface of the container. The container includes a an annular interference ring located axially under the thread formation. The closure includes a separable, annular tamper indicating band depending from the skirt portion. The band is detachably connected to the skirt portion by a plurality of circumferentially spaced, frangible bridge-like connectors extending between the skirt portion and the band. The band includes first and second axially spaced apart, inwardly extending camming projections extending inwardly therefrom. The camming projections are configured to dampen a snap-back effect as the closure is initially applied to the container, to preclude breaking the bridge-like connectors during initial application of the closure.

2 Claims, 3 Drawing Sheets

TAMPER INDICATING CLOSURE WITH DUAL-CAMMING PROJECTION BAND

FIELD OF THE INVENTION

This invention relates to a tamper indicating closure. More particularly, the invention relates to a tamper indicating closure having a tamper-evident or pilfer band having a dual-camming projection interior surface for facilitating application of the closure to a container.

BACKGROUND OF THE INVENTION

Container closures, and more specifically, tamper-indicating or tamper-evident closures are well known in the art. In a typical arrangement, a threaded container includes a locking ring, or like annular projection extending from the container finish, adjacent to and below the container threaded portion.

A closure which is fitted to the container includes a plastic closure cap having a circular top wall portion and a depending annular skirt portion. The skirt portion has an internal thread configured to threadedly engage the container thread. Tamper indication is provided by a separable band which extends and depends from the skirt portion. The band engages the locking ring and separates from the skirt portion as the closure is removed from the container. The band includes bridge-like connectors which extend between the skirt portion and the band that break as the closure is removed from the container. Exemplary of such a closure is that disclosed in U.S. Pat. No. 5,450,972 to Zemlo, which patent is commonly assigned herewith, and is incorporated herein by reference.

In one known tamper-indicating closure, the separable band includes a cam-like projection which extends inwardly from an inner surface of the band. The cam coacts with the locking ring and provides resistance during removal of the closure. As the closure is rotated off the container and the locking ring and cam engage one another, the bridge-like connectors yield and the band separates from the closure skirt portion.

Other known tamper-indicating band configurations include wings or tabs formed as part of the band that are adapted to coact with the container locking ring. Upon removal of the closure from the container, the wings or tabs flex and engage the locking ring. The tabs or wings provide sufficient resistance to overcome the yield strength of the connectors.

Currently known tamper-indicating closure configurations work well to accomplish their intended objective, i.e., to provide visibly discernible evidence of tampering. However, such configurations may prove to be troublesome when initially applying the closure to the container. In particular, it has been observed that one or more of the bridge connectors of the tamper-indicating band may separate from the skirt portion as the closure is applied to the container. Breaking of these connectors during application could thus place an otherwise untampered container in an apparent tampered condition due to unintentional band separation and tamper indication.

Accordingly, there continues to be a need for a closure tamper-indicating band in which the band remains intact with the closure cap skirt portion as the closure is initially applied to the container, and in which the band separates from the closure cap upon disengaging the closure from the container.

SUMMARY OF THE INVENTION

A tamper indicating closure for use with an associated container includes a closure cap having a circular top wall portion, and a depending annular skirt portion depending from said top wall portion. The cap is used with a container having a finish and an external thread formation thereon and an annular interference ring located axially under the thread formation.

The closure skirt portion has an internal thread formed therein that is adapted to threadedly engage the container thread. The skirt portion may include a seal retaining element therein. The retaining element is adapted to retain a seal in the cap to provide a leak proof seal between the container and the closure cap.

The closure includes a separable, annular tamper indicating band depending from the skirt portion. The band is detachably connected to the skirt portion by a plurality of circumferentially spaced, frangible bridge-like connectors extending between the skirt portion and the band. The band includes an internal surface or inner wall configured for engaging the locking ring for separating the band from the skirt portion. The internal surface has first and second axially spaced apart, inwardly extending camming projections.

The dual camming projections advantageously prevent separation of the band from the cap during initial application of the closure to the container. The dual camming projections provide a two-stage snap-back of the band from the stressed state as it is applied to the container, over the locking ring, to its pre-application, non-stressed state.

In a preferred embodiment, the camming projection distal most from the top wall portion extends inwardly a distance greater than the other camming projection. Preferably, the camming projections and the surfaces therebetween are arcuately formed. Alternately, one or both of the upper and lower base portions of the second projection are relatively planar surfaces at angles of about 131° and 3°, respectively, relative to the inner surface.

The camming projections are further adapted to engage the locking ring as the closure is twisted to remove it from the container. The projections resist removal of the cap from the container by engaging the locking ring. Continued twisting of the cap urges the band outward, as the cap is urged upward, which breaks the connectors between the band and the cap.

Other features and advantages of the present invention will be apparent from the following detailed description, the accompanying drawings, and the appended claims.

DETAILED DESCRIPTION OF THE PREFERRED EMBODIMENTS

Figure 1:
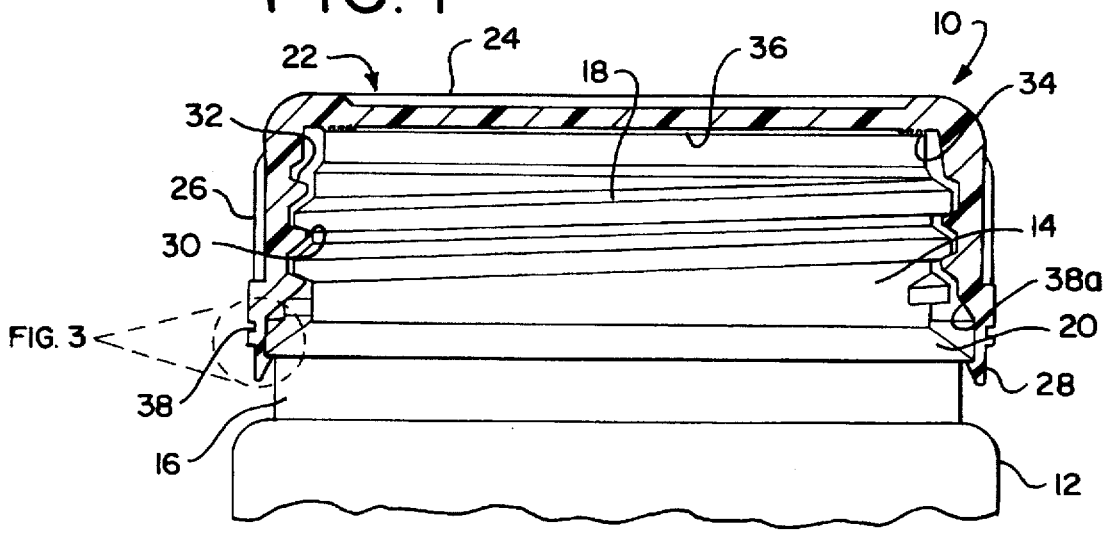
FIG. 1 is a cross-sectional view of a closure embodying the principles of the present invention, the closure being illustrated threadedly engaged with an associated container.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures, and particularly, to FIG. 1, there is shown a container closure 10 embodying the principles of the present invention. The closure 10 is shown with an associated container 12 to which the closure 10 is fitted. The container 12 includes a finish portion 14, which is that portion of the container 12 which includes the container neck 16 and that portion of the container 12 to which the closure 10 is engaged.

The container finish 14 includes an external thread formation 18 thereon for threadedly engaging the closure 10. The finish 14 includes an annular projection 20 extending from the container, adjacent to and axially below the threaded portion 18. In a preferred embodiment, the annular projection 20 constitutes a locking ring or interference ring which is adapted to engage the closure 10.

The closure 10 includes a closure cap 22 having a circular top wall portion 24 and a depending annular skirt portion 26 depending from the top wall portion 24. A tamper-evident band 28 depends from the skirt portion 26. The band 28 is configured to provide visibly discernible evidence that the closure 10 has been removed from the container 10, that the container 10 may have been opened or that the contents may have been otherwise tampered with.

The skirt portion 26 includes a thread formation 30 on an inner surface 32 thereof. The thread 30 is configured to threadedly engage the container finish thread 18 for applying the closure 10 to the container 12. The closure 10 can include a circumferential seal retaining element 34 therein to facilitate retaining a seal 36 or like member to provide a leak proof seal between the container 12 and the cap 22. In one embodiment, the seal retaining element 34 includes one or more coaxially formed, continuous, relatively small projecting ridges formed on an inner surface of the top wall portion 24.

Figure 2:
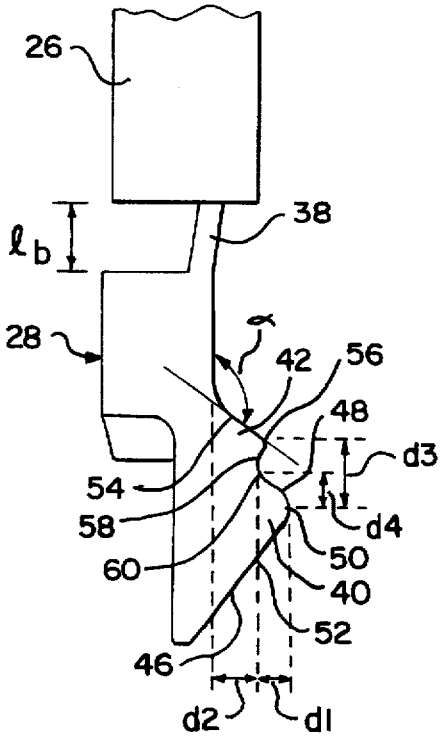
FIG. 2 is a cross-sectional view illustrating, in part, the depending skirt portion of the closure cap and the tamper-evident band, the closure cap being illustrated without the associated container for clarity of illustration.

Referring now to FIGS. 1 and 2, the closure 10 tamper evident band 28 depends from the skirt portion 26, and extends circumferentially thereabout. FIG. 2 illustrates a cross-section of the band in a pre or post application, non-stressed state. The band 28 is connected to the skirt portion 26 by a plurality of bridge-like connectors 38 which extend between the band 28 and the skirt portion 26. The bridge-like connectors 38, which have a length $l_b$, are frangible connections which break or yield as the closure 10 is twisted or threadedly disengaged from the container 12, and as the band 28 is urged from the closure 10.

Unlike known closures, the tamper-evident band 28 includes first and second camming projections 40, 42 on an inside surface 44 thereof. The camming projections 40, 42 permit initial placement of the closure 10 onto the container 12, while reducing or eliminating the possibility that one or more of the connectors 38 will break, and that the band 28 will separate from the cap 22 as the closure 10 is applied to the container 12. The projections 40, 42 are further adapted to facilitate separation of the band 28 from the skirt portion 26 as the closure 10 is removed from the container 12, to provide tamper indication.

As best seen in FIG. 2, the first camming projection 40 extends inwardly of the band 28 a distance greater than the second camming projection 42. The first camming projection 40 further includes an inclined or ramped surface 46 extending from about the end of the band 28, upward to about the second projection 42. The inclined surface 46 facilitates initial application of the closure 10 to the container 12.

The second camming projection 42 is recessed from the first projection 40. The second projection 42 extends inwardly of the band 28 a distance less than the first projection 40, and a distance greater than the inside surface 44 of the band 28. Thus, the second camming projection 42 defines an intermediate position relative to the inside wall 44 and the first projection 40.

Each of the camming projections 40, 42 includes an upper base portion, a peak and a lower base portion, 48, 50 and 52, and 54, 56 and 58, respectively for the first and second projections 40 and 42. The peaks 50 and 56, which define the inwardly most extending portion of their respective projections 40, 42, are curved or arcuate surfaces. In a current embodiment of a 38 millimeter closure 10, the peak 50 has a radius of curvature of about 0.305 mm (0.012 inches), and the peak 56 has a radius of curvature of about 0.127 mm (0.005 inches).

The upper base portion 54 of the second projection 42 defines an angle $\alpha$ relative to the inside wall 44. As best seen in FIG. 2, the upper base portion 54 is at an angle $\alpha$ of about 131° relative to the inside wall 44.

The lower base portion 58 of the second projection 42 and the upper base portion 48 of the first projection 40 define a transition region 60. In a preferred embodiment, the transition region 60 defines an arcuate or curved surface. In the exemplary 38 mm closure 10, the region 60 surface has a radius of curvature of about 0.254 mm (0.010 inches).

Figure 2B:
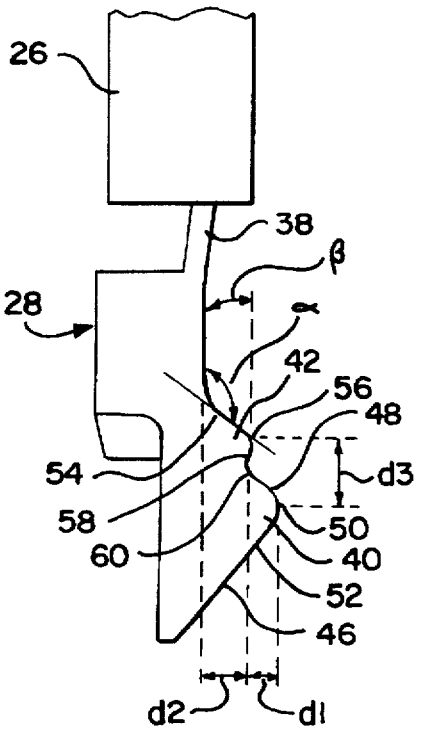
FIG. 2B is a cross-sectional view similar to FIG. 2 showing an alternate configuration for the second projection lower base portion.

In a preferred embodiment, the second projection lower base portion 58, between the peak 56 and the transition region 60 is arcuate,i.e., concave, relative to the projections 40, 42. Alternately, as illustrated in FIG. 2B, the lower base portion 158 may be a planar surface formed at an angle $\beta$ relative to the inside wall 44. In the embodiment illustrated in FIG. 2B, the lower base portion 158 is at an angle $\beta$ of about 3° relative to the inside wall 44.

In the exemplary 38 millimeter closure 10, the circumferential distance $d_1$ between the peak 56 of the second projection 42 and the peak 50 of the first projection 40 is about 0.711 mm (0.028 inches). The circumferential distance $d_2$ between the peak of the second projection 42 and the inner surface 44 is about equal to the distance $d_1$. The axial distance $d_3$ between the peaks of the first and second projections 50, 56 is about 0.762 mm (0.030 inches). The axial distance $d_4$ between the peak 50 of the first projection 40 and the transition region 60 is in a range of about ⅓ to about ⅔ of the connector length $l_b$, and is preferably at least about ⅓ of the length $l_b$.

It will be recognized by those skilled in the art that the above-noted radii of curvature and distances are for example purposes only and are then only applicable for the exemplary 38 mm closure. Other cap sizes may require different distances between the physical features of the closure, as may different distances be used in closures of a 38 mm design.

Figure 3:
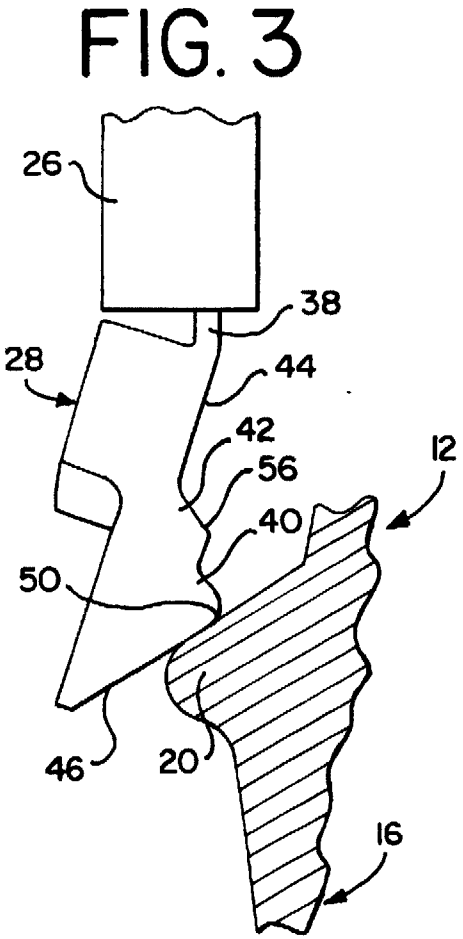
FIG. 3 is a cross-sectional illustrating the closure cap as it is being applied to the container, showing the tamper-evident band urged outward as the inclined surface engages and container interference ring.
Figure 4:
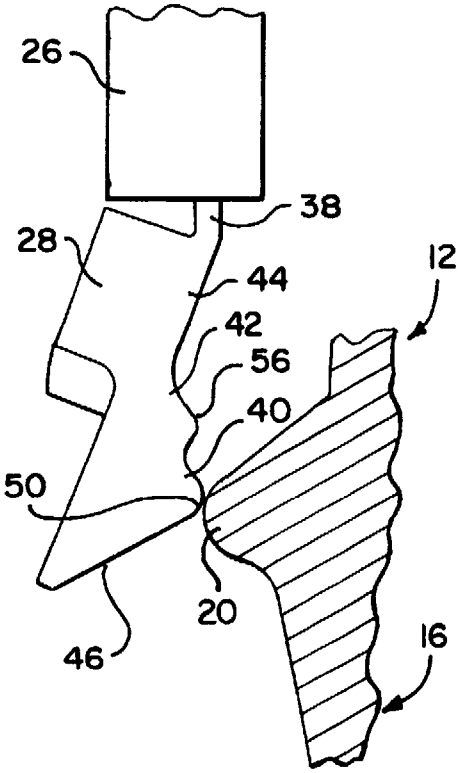
FIG. 4 is a cross-sectional view similar to FIG. 3, illustrating the closure cap further applied to the container, as the first camming projection of the band passes over the container interference ring.

Referring now to FIGS. 3–6, as the closure 10 is applied to the container 12, the first camming projection 40 is forced below the lower surface of the interference ring 20 (FIG. 3). It is contemplated that a conventional capping method will be used to initially engage the closure 10 to the container 12. Thus, the method would comprise screwing the closure 10 onto the container 12 whereby the closure threads 30 engage the container threads 18 while the band 28 slides down and over the interference ring 20, as illustrated in FIGS. 3–6.

Figure 5:
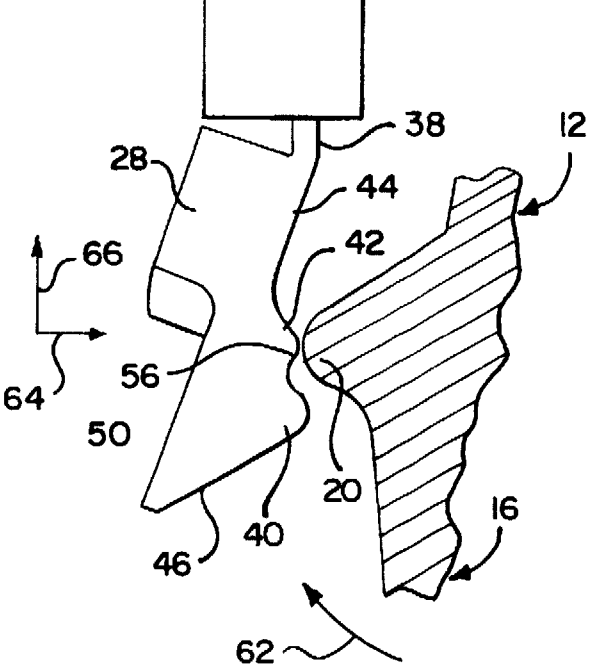
FIG. 5 is a cross-sectional view similar to FIGS. 3 and 4, illustrating the closure cap still further applied to the container, as the second camming projection of the band passes over the container interference ring.

As the band is slid over the interference ring 20, the first camming projection 40 urges the band 28 outwardly, as illustrated by the arrow at 62. As the first camming projection 40 passes over and beyond the ring 20, the second camming projection 42 precludes an excessive inward and downward snap-back action of the band 28 (as illustrated by the arrows at 64 and 66, respectively), which might break one or more of the connectors 38. Thus, the second projection 42 dampens and reduces the snap-back effect and produces a two-stage return of the band 28 to its non-stressed, pre-application state, with the band disposed below the ring, as illustrated in FIG. 5. The closure 10 is then fully applied to the container 12, and the band 28 comes to rest with the first camming projection 40 below the interference ring 20, and the interference ring 20 resting adjacent to the band inside surface 44.

It has been observed that the two-stage return of the band 28 to its non-stressed state reduces the opportunity for, and may preclude inadvertently breaking the connectors 38 which can otherwise result from the snap-back action. The snap-back action has been observed to produce axial and radial stresses in the connectors 38, other than the stresses which result from the outward urging of the band 28 relative to the cap 22 during application. These additional axial and radial stresses could result in tearing the connectors 38 in either or both the radial and axial directions as the closure 10 is applied to the container 12.

The dual camming projections 40, 42 reduce the opportunity for tearing of the connectors 38. The projections 40, 42 produce a two-step damping effect, which reduces the stresses resulting from snap-back. The reduced stresses in turn reduce the opportunity for yielding of the bridge-like connections 38.

When it is desired to access the contents of the container 12 and to remove the closure 10, the closure 10 is grasped and the cap 22 is twisted off. As twisting torque is applied to remove the cap 22, the second camming projection 42 contacts and engages the interference ring 20, which urges the band 28 outward. Continued twisting of the cap 22 contacts the first camming projection 40 with the interference ring 20 which urges the band 28 further outward.

Figure 7:
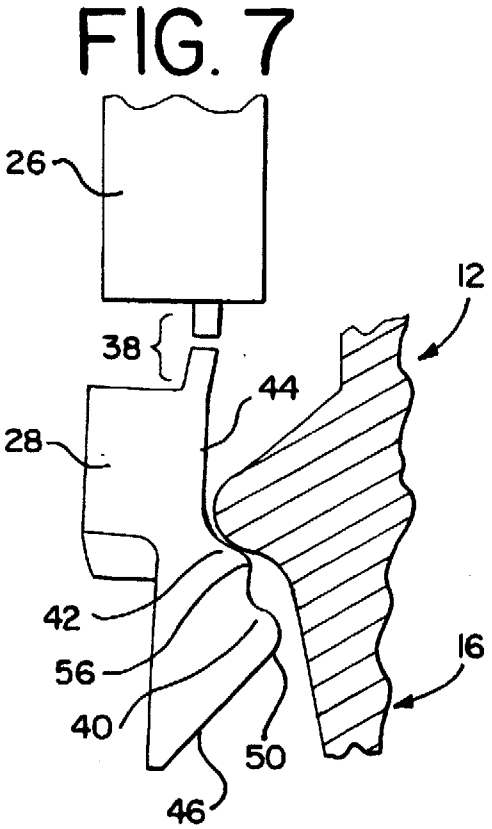
FIG. 7 is a cross-sectional view of the band with the bridge-like connectors broken or severed as the cap is removed from the container.
Figure 6:
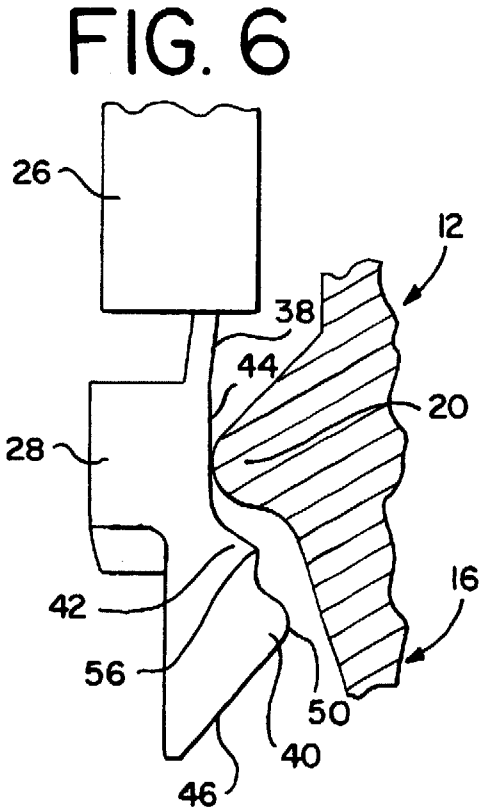
FIG. 6 is a cross-sectional view similar to FIGS. 3–5, illustrating the closure cap fully applied to the container, with the container interference ring resting adjacent to the band inside surface.

As illustrated in FIG. 7, as the closure 10 is rotated along the container threads 18, the upward force translated from the twisting motion, along with the outward urging of the band 28 creates a tearing or severing force on each of the bridge-like connections 38, which may produce a sequential breaking of the connectors 38. The tearing force is a result of the cap 22 being forced upward relative to the container 12, while the band 28 is obstructed from upward movement due to the contact between the interference ring 20 and the and the camming projections 40, 42.

In the exemplary embodiment of a 38 mm closure, fifteen relatively thin, circumferentially narrow connectors 38, and one larger connector **38*a* are included. This configuration permits the larger connector 38*a* to remain intact while the other, smaller connectors are broken. In such a configuration, the band 28 will remain around the container neck 16, below the interference ring 20, and the cap will remain attached to the band 28 by the larger connector 38*a*. Thus, the cap 22 will remain attached to the container 12. Alternately, the closure 10 can be configured so that the cap 22 is fully separable from the band 28. That is, in the alternate configuration, all of the connectors are configured to break or sever when the closure 10 is removed from the container 12**.

It will be recognized by those skilled in the art that the camming projections 40, 42 need not be continuous circumferential elements, but can be formed as a plurality or series of independent projections extending inwardly from the inside surface 44 of the band 28.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

What is claimed is:

1. A tamper indicating closure for use with an associated container, the container having a finish having an external thread formation thereon and including an annular locking ring located axially under the thread formation, the closure comprising:

a closure cap having a circular top wall portion, and a depending annular skirt portion depending from said top wall portion, said skirt portion having an internal thread formed therein adapted to threadedly engage the container thread formation; and an annular tamper indicating band depending from said skirt portion, said band being detachably connected to said skirt portion by a plurality of circumferentially spaced, frangible connectors extending between said skirt portion and said band, said band including an internal surface configured for engaging said locking ring for separating said band from said skirt portion, said internal surface having first and second axially spaced apart, inwardly extending camming projections extending inwardly therefrom, wherein said first camming projection includes an inclined lower base portion, a peak portion having a predetermined radius of curvature and an upper base portion terminating in a continuously curving transition region having a predetermined radius of curvature, and wherein said second camming projection includes an upper base portion defining an angle relative to said internal surface, a peak portion having a predetermined radius of curvature and a lower base portion terminating at said transition region, said second camming projection upper base portion through said transition region defining a continuously curving surface therebetween, said first and second camming projections extending inwardly of said band relative to said transition region and being configured to dampen a snap-back effect and reduce stresses in said connectors when said closure is initially applied to the container, when said band passes over the annular interference ring.

2. The tamper indicating closure in according to claim 1 including a connector adapted to remain intact when said closure cap is removed from the container.

* * * * *